United States Patent [19]

Todd

[11] Patent Number: 4,991,769

[45] Date of Patent: Feb. 12, 1991

[54] REMOVABLE MAIL BOX COVER DISPLAY

[75] Inventor: Curtis L. Todd, St. Louis County, Mo.

[73] Assignee: Mailwraps, Inc., St. Louis, Mo.

[21] Appl. No.: 432,154

[22] Filed: Nov. 6, 1989

[51] Int. Cl.[5] ..... B65D 91/00

[52] U.S. Cl. ..... 232/17; 232/38; D99/27

[58] Field of Search ..... 232/17, 38; 248/206.5; 211/DIG. 1; D99/29

[56] References Cited

U.S. PATENT DOCUMENTS

| | | | |
|---|---|---|---|
| D. 305,824 | 1/1990 | Carter | D99/29 |
| 4,244,512 | 1/1981 | Wise | 232/17 |
| 4,368,842 | 1/1983 | DeLange | 232/17 |
| 4,375,869 | 3/1983 | Hatch | 232/17 |
| 4,736,853 | 4/1988 | O'Mara | 248/206.5 X |
| 4,813,595 | 3/1989 | Johns et al. | 232/17 |

*Primary Examiner*—Robert W. Gibson, Jr.

*Attorney, Agent, or Firm*—Summers, Compton, Wells & Hamburg

[57] ABSTRACT

A removable rural or suburban mailbox cover is characterized by a flexible covering having messages or images imprinted on one side. The cover is constructed with cut outs so as not to interfere with the delivery flag, hinges and latching device of the mailbox. The cover is affixed to the mailbox through magnetic strips or by fastening devices inserted through holes in the cover.

5 Claims, 2 Drawing Sheets

REMOVABLE MAIL BOX COVER DISPLAY

BACKGROUND OF THE INVENTION

This invention relates to the field of mailboxes and more particularly to removable covers thereof, having a display thereon.

A typical free-standing rural type mailbox is widely used throughout this country. Usually the mailboxes are plain, unadorned and fabricated from sheet metal. However, there are available mailboxes having permanently painted surfaces, either with or without pictorial displays or other decorative designs. There are also various permanent covers to the standard rural mailbox providing a specific design. An example of such arrangement is found in U.S. Pat. No. 4,712,731, which provides a permanently affixed plywood covering of the mailbox. Other mailbox covers have been developed purely for security purposes to prevent vandalism, as for example, U.S. Pat. No. 4,368,842. There are also purely decorative mailbox covers made in specific designs, in the form of various design patents such as U.S. Pat. No. DES. 287,899. Finally, there is the concept of a permanently affixed clear cover having means for holding a picture adjacent to the cover to be viewed from the outside as in U.S. Pat. No. 4,244,512.

One of the objects of this invention is to provide permanent, but easily replaceable mailbox covers.

Another object of this invention is to provide a mailbox cover which if defaced due to the elements or marked due to vandalism may be inexpensively replaced.

Another object of this invention is to provide mailbox covers for occasions, having announcements such as "It's a Boy" or "Happy Birthday" or "Merry Christmas" or similar transitory signs which denote a celebratory event.

Another object of this invention is to provide a mailbox covering which protects the basic underlying top and opposed longitudinal side surfaces of the mailbox.

Other objects will be apparent to those skilled in the art in light of the following description and accompanying drawings.

SUMMARY OF THE INVENTION

In accordance with this invention, generally stated, is a mailbox cover comprising flexible, durable, material which is the same size as the exterior surface of a U.S. Postal Service rural mailbox, excluding the mailbox ends. The cover is capable of being bent in an arcuate configuration to cooperatively overlay the top and opposed longitudinal side surfaces of the mailbox. Opposite sides of the cover have adhesively fixed magnetic strips placed on the inside (mailbox side) of the cover. The strips enable the cover to be held by the force of magnetism over the exterior of the mailbox by engaging the magnetic strips against the opposed longitudinal side surfaces of the mailbox.

DESCRIPTION OF THE PREFERRED EMBODIMENTS

The following description of the present invention is intended to be merely illustrative and not limiting.

Figure 1:
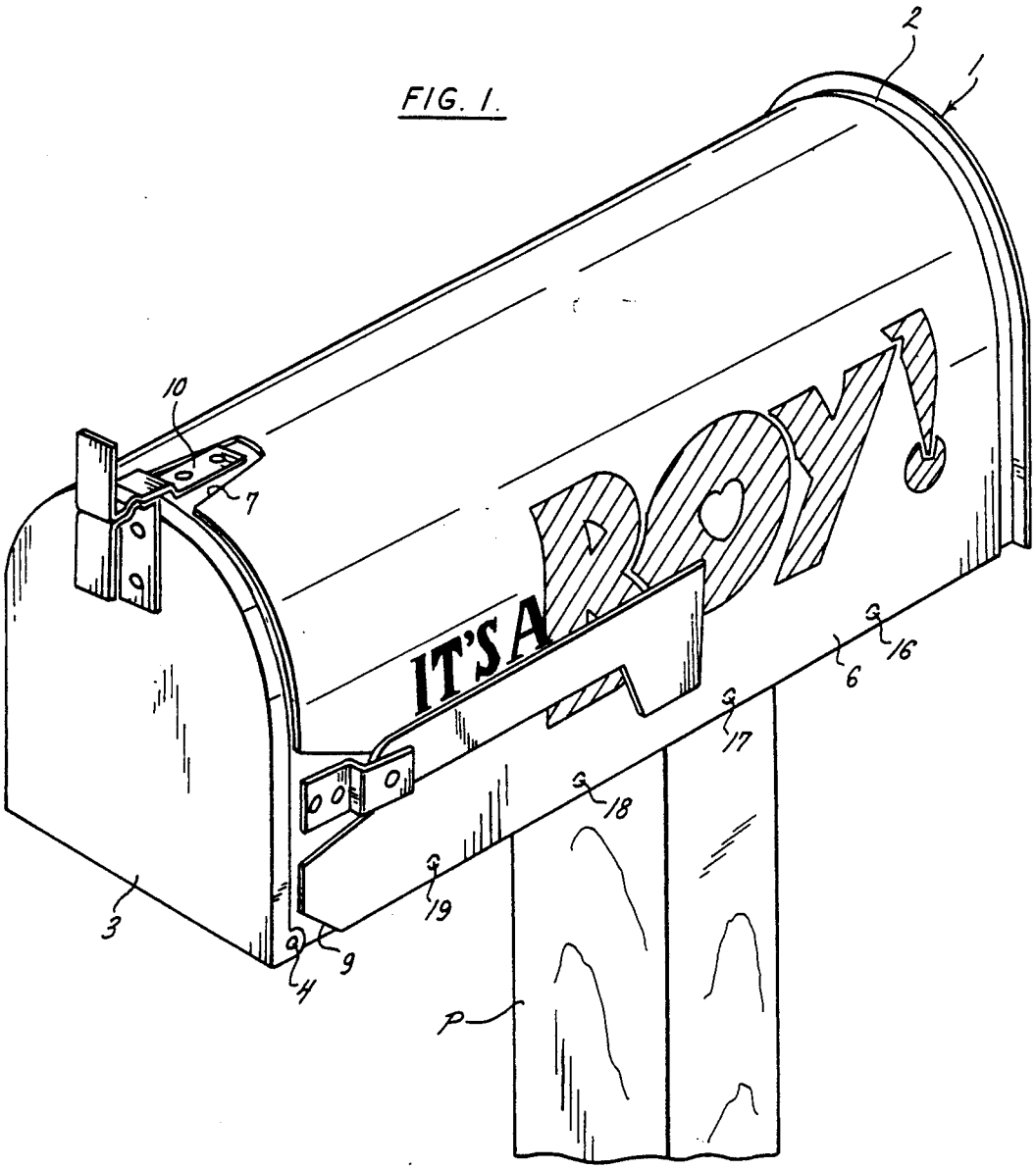
FIG. 1 is a perspective view of a mailbox cover constructed in accordance with the current invention.
Figure 2:
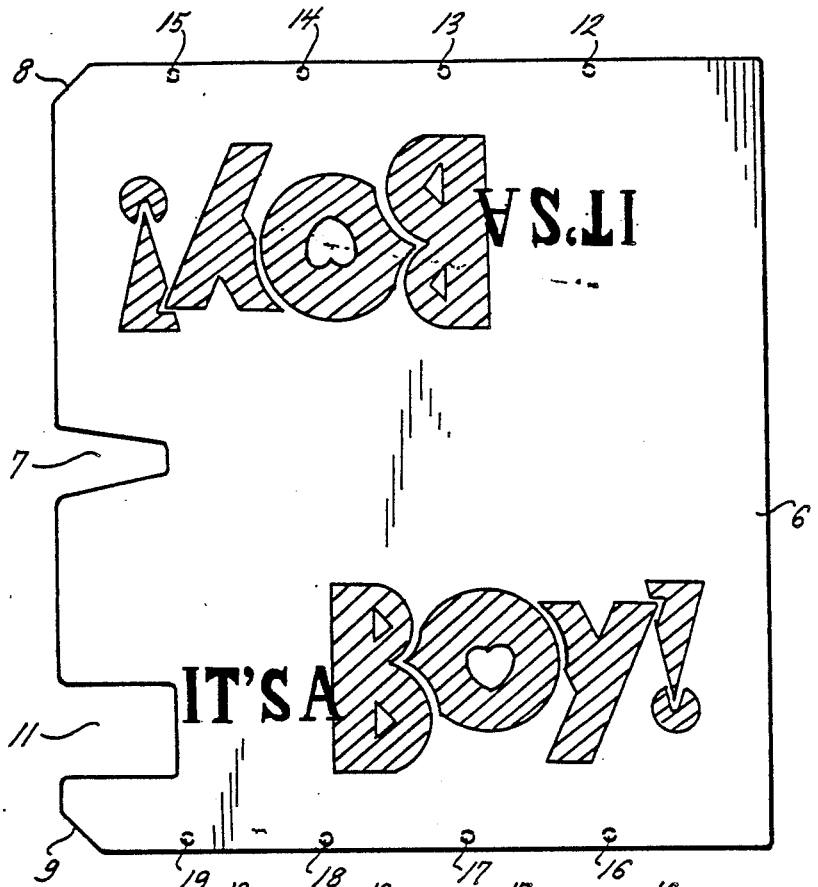
FIG. 2 is a top view of a mailbox cover constructed in accordance with the current invention.
Figure 3:
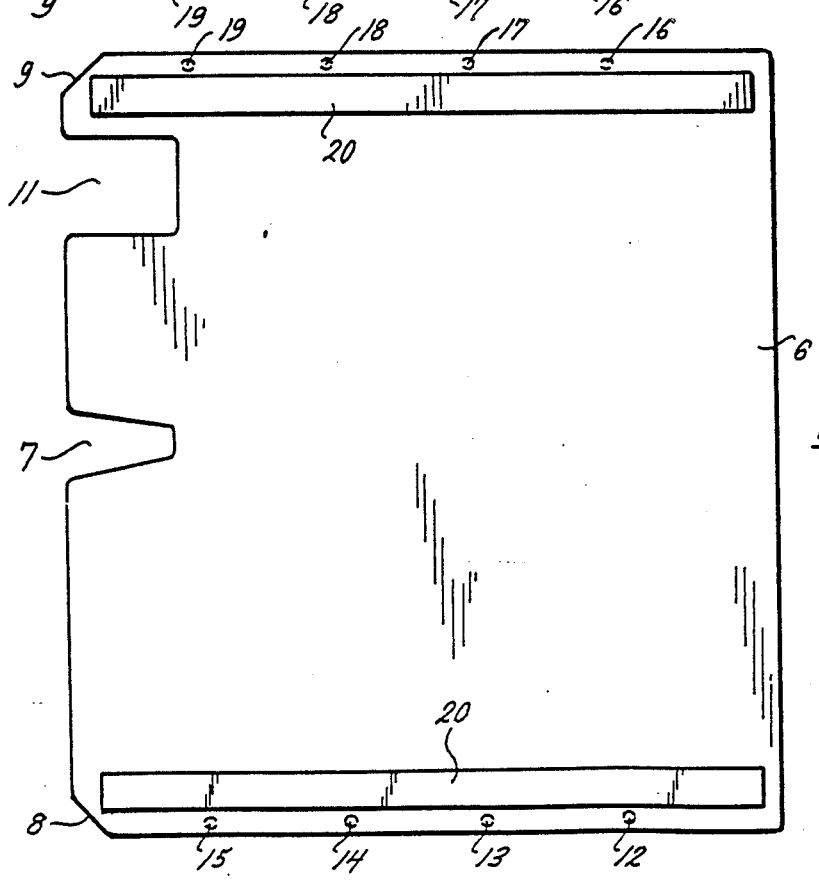
FIG. 3 is a plan view of the inside of the cover in accordance with the current invention.

Referring now to the drawings, and particularly to FIGS. 1, 2 and 3, there is shown one illustrative embodiment of the removable mailbox cover.

Referring in particular to FIG. 1, there is shown a mailbox (1) that includes a base (2), and a door (3) connected by a hinge (4) to the base. The mailbox is affixed to a post (P) in the conventional fashion.

The mailbox (1) is shown with its exterior surface covered in FIG. 1 by a cover (6) made of a flexible mineral filled polypropelene plastic imprinted on the exterior with various designs. (In this instance, a birth announcement.) The mineral filled polypropelene cover (6) is provided with four cut outs along one of its sides. The cut outs allow placement over and around various elements of the mailbox. For example, the cover (6) has a first cut out (7) to allow for the placement of the cover around a latch (10) of the mailbox. The mailbox also has second and third cut outs (8) (9) to allow the cover to be positioned around door hinges (4) to permit the hinges to operate without binding on the cover (6).

Referring now to FIG. 2, the cover (6) also has a fourth cut out (11) to allow for the operation of the mailbox delivery flag. The cover (6) is also provided with partial cut outs (12), (13), (14), (15), (16), (17), (18), and (19) to allow fixture of the cover to the mailbox by fasteners in the unlikely event that the mailbox is constructed of aluminum or other non-magnetic material.

Referring now to FIG. 3, the cover (6) has affixed to its opposite sides a pair of strips of magnetic material (20). The strips of magnetic material carry a permanent magnetic field impressed thereon and are adhesively secured to the cover (6). The strips enable the cover to be solidly held by the force of magnetism to the surface of the mailbox by engaging the strips against the two opposed longitudinal sides of the mailbox.

Numerous variations in the construction of the device of this invention, within the scope of the appended claims, will accord to those skilled in the art in the light of the foregoing disclosure. Merely by way of example in this embodiment the cover has been made of polypropelene material, however, it could as easily be made of any durable, semi-permanent or permanent material, such as coated paper or the like.

Thus having described the invention, what is claimed and desired to be secured by Letters of Patent is:

1. A removable mailbox cover adapted to overlay an exterior surface of a rural type mailbox having at least a top and two opposed longitudinal sides, the cover having a general rectangular shape and being formed from a flexible material that enables the cover to be bent in an arcuate configuration to overlay the top and two opposed longitudinal sides of the mailbox, and the cover having a pair of strips of magnetic material fixed thereto, each strip being fixed along an opposite side of the cover and enabling the cover to be removably held by magnetism to the two opposed longitudinal sides of the mailbox by engaging the strips against the two opposed longitudinal sides.

2. The cover of claim 1, wherein:

a side of the cover extending between the two strips has a cut out therein, the cut out enabling placement of the cover over the exterior surface of the mailbox and around a door latch of the mailbox.

3. The cover of claim 1, wherein:

a side of the cover extending between the two strips has a first and a second cut out therein, the first cut out enabling positioning of the cover around a door latch of the mailbox and the second cut out enabling positioning of the cover around a delivery flag of the mailbox.

4. The cover of claim 2, wherein:

the side of the cover extending between the two strips has a second and third cut out therein, the second and third cut outs enabling positioning of the cover around door hinges of the mailbox to thereby permit the hinges to operate without binding on the cover.

5. A removable mailbox cover adapted to overlay an exterior surface of a rural type mailbox having at least a top and two opposed longitudinal sides, the cover having a general rectangular shape and being formed from a flexible material that enables the cover to be bent in an arcuate configuration to overlay the top and two opposed longitudinal sides of the mailbox, and the cover having a pair of strips of magnetic material affixed thereto, each strip being fixed along an opposite side of the cover and enabling the cover to be removably held by magnetism to the two opposed longitudinal sides of the mailbox by engaging the strips against the two opposed longitudinal sides.

* * * * *